US005820525A

United States Patent [19]

Riley

[11] Patent Number: 5,820,525

[45] Date of Patent: Oct. 13, 1998

[54] TREADMILL CONTROL

[76] Inventor: Ronald J. Riley, 1323 W. Cook Rd., Grand Blanc, Mich. 48439

[21] Appl. No.: 631,026

[22] Filed: Apr. 12, 1996

[51] Int. Cl.[6] ..... A63B 22/02

[52] U.S. Cl. ..... 482/54; 482/901; 482/902; 482/51

[58] Field of Search ..... 482/51, 54, 70, 482/71, 1, 901, 902

[56] References Cited

U.S. PATENT DOCUMENTS

| | | | |
|---|---|---|---|
| 4,426,075 | 1/1984 | Otte . | |
| 4,708,337 | 11/1987 | Shyu . | |
| 4,771,148 | 9/1988 | Bersonnet . | |
| 4,923,191 | 5/1990 | Persico . | |
| 5,034,576 | 7/1991 | Dalebout et al. . | |
| 5,100,127 | 3/1992 | Melnick et al. . | |
| 5,314,391 | 5/1994 | Potash et al. . | |
| 5,318,487 | 6/1994 | Golen et al. . | |
| 5,368,532 | 11/1994 | Farnet . | |
| 5,383,826 | 1/1995 | Michael | 482/1 |
| 5,476,430 | 12/1995 | Lee et al. . | |
| 5,489,250 | 2/1996 | Densmore et al. . | |

*Primary Examiner*—Lynne A. Reichard
*Attorney, Agent, or Firm*—Howard & Howard

[57] ABSTRACT

A device and methodology for controlling a treadmill motor (32) enhances user safety by providing an automatic shutoff of all power to the motor (32) under prescribed conditions. The treadmill motor (32) drives a belt (18) in response to a sequence of electrical signals being generated by the user through a control panel (14), for example. If there is a delay between the required signals that exceeds a preselected time period, all power is shut off to the motor (32) until the proper sequence of signals is restarted. In one embodiment, the treadmill running surface (18) is foldable from a use position (86) into a storage position (88). This invention prevents the motor (32) from being powered unless the belt (18) is in the use position.

20 Claims, 4 Drawing Sheets

TREADMILL CONTROL

BACKGROUND OF THE INVENTION

This invention relates to a device and methodology for controlling a motor that drives a belt in a treadmill. More particularly, this invention relates to a system for controlling a treadmill motor that drives a belt in response to a particular sequence of electrical signals by monitoring the timing sequence of those signals and by determining whether the treadmill is appropriately positioned for use.

With the recent increase in popularity of treadmill exercise machines, a variety of controls have been developed. For example, U. S. Pat. No. 5,368,532, issued on Nov. 29, 1994, shows an automatic speed control system for a treadmill. That speed control system operates depending upon the position of a user on the treadmill running surface. A pair of sensors are located under the running surface for producing digital signals that are indicative of the user's position on the treadmill.

One feature of the controller of the '532 Patent is that it has a timer-based shutoff control. A warm-up mode, where the motor drives the belt at a relatively low speed, enables a user to become comfortable and properly positioned on the treadmill before the treadmill operates at full speed. If the sensors below the treadmill running surface do not detect the presence of a user on the belt within a specific time during the warm-up mode, the belt is stopped. Such a shut-off system is useful for some applications, however, it is inadequate for others.

First, to implement a system as described in the '532 Patent requires relatively expensive components that effectively prohibits the use of such a system in many applications. Moreover, the above-described shut-off system fails to address a potential safety issue presented by some commercially available treadmills.

In some treadmills a user must turn the system on and then choose an operating speed by depressing two different buttons. Once the speed selection button is depressed, the belt begins to rotate at the selected speed. An undesirable drawback of such systems is that it is possible for one user to depress the "on" button and then leave the treadmill unattended. A second user then approaches the treadmill and may accidentally or intentionally press one of the speed selection buttons while not expecting the treadmill to operate. Because the "on" button has been pushed by a previous user, however, the treadmill unexpectedly moves at the selected speed, creating a potential safety hazard. For example, the user may be unexpectedly thrown from the treadmill if the belt suddenly operates at a high speed.

Other treadmills present further potential safety hazards. Some commercially available treadmills are foldable into upright, storage positions. It is important that such treadmills not operate in an upright condition because the moving belt can present a potential for injury to those standing near the treadmill.

Therefore, it is desirable to provide a treadmill control that ensures that the treadmill will not operate unless it is properly positioned for use. Further, a treadmill control should require that a sequence of operating signals be generated within a preselected time in order to prevent the belt from unexpectedly accelerating rapidly.

SUMMARY OF THE INVENTION

In general terms, this invention is a system for controlling a treadmill that has a motor that drives a belt including a control panel that has signal producing means for producing a plurality of signals. The plurality of signals include an initiation signal and a mode selection signal. A signal detecting means, coupled between the control panel and the motor, detects when each of the plurality of signals is produced by the control panel. A position determining means determines whether the belt is properly positioned for use. A preventing means prevents the motor from being powered to drive the belt when the belt is not properly positioned for use. A shut-off means is coupled to the signal detecting means and monitors the time period between production of the initiation signal and production of the mode selection signal. The shut-off means shuts off all power to the motor when the time period between production of the two signals exceeds a preselected maximum.

BRIEF DESCRIPTION OF THE DRAWINGS

The various features and advantages of this invention will become more apparent to those skilled in the art from the following detailed description of the presently preferred embodiment. The drawings that accompany the detailed description can be described as follows.

DETAILED DESCRIPTION OF THE PREFERRED EMBODIMENTS

Figure 1:
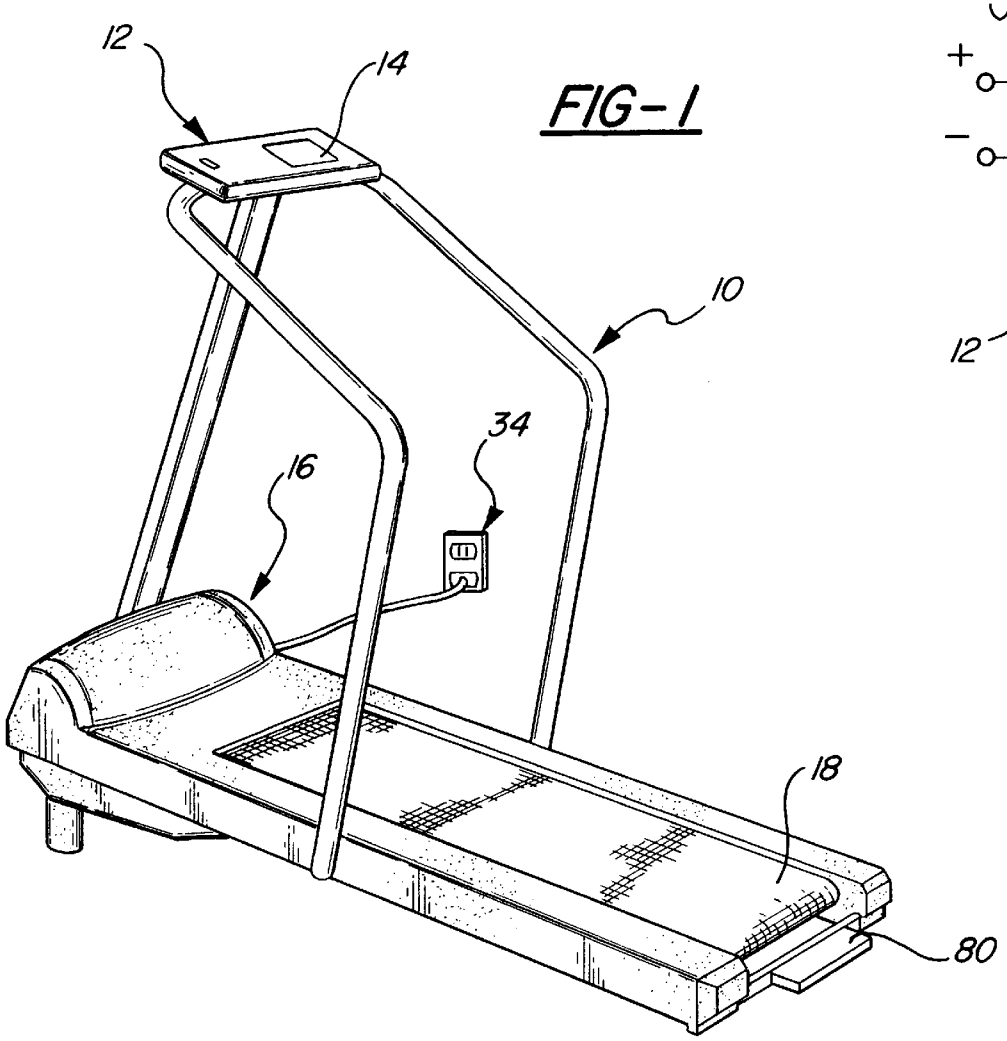
FIG. 1 is a perspective view of a treadmill.

FIG. 1 illustrates a treadmill 10 having a control panel 12 including a signal producing means 14. The control panel 12 enables a user to operate the treadmill 10 in accordance with a desired exercise program. The signal producing means 14, for example, produces a plurality of signals that cause a motor, which is housed within a motor housing 16, to drive a belt 18 at a particular speed.

Figure 2:
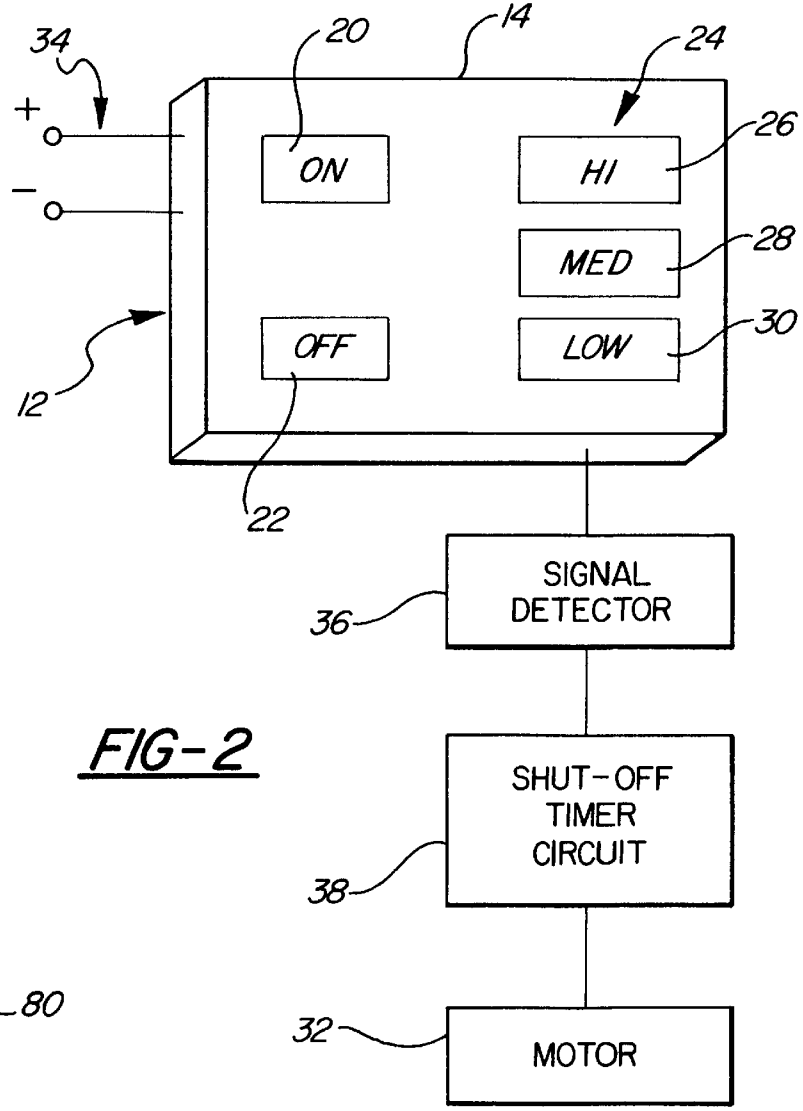
FIG. 2 is a block diagram of selected components of a system designed in accordance with this invention.

Referring to FIG. 2, the signal producing means 14 includes an "on" button 20 and an "off" button 22. The signal producing means 14 also includes a means 24 for producing a mode selection signal. In the illustrated embodiment the mode selection signal is generated by depressing one of the buttons 26, 28 or 30.

In order to operate the treadmill 10, a user first depresses the "on" button 20 to generate an initiation signal. The initiation signal effectively couples a motor 32 to a conventional power supply 34 but does not cause the motor to operate. The user then selects a speed, medium, for example, by depressing the button 28 to generate a mode selection signal. Once the mode selection signal is generated, the motor 32 operates at the selected speed, driving the belt 18 accordingly. The "off" button 22 can be depressed at any time to disconnect the motor 32 from the power supply 34.

A detecting means 36 and a shut-off means 38 are provided in order to reduce the possibility of a user being injured due to an unexpected rapid acceleration of the belt 18. The detecting means 36 includes a signal detector that determines when the initiation and mode selection signals are produced. The shut-off means 38 includes a shut-off timer circuit that turns off all power to the motor 32 in the event that the mode selection signal is not produced within a preselected time period after the initiation signal is produced.

A system designed according to this invention is particularly useful in commercial displays where a number of different people may sample a treadmill. It is possible that one user depressed the button 20 and then left the treadmill 10 unattended. A second user may step on the belt 18 and, assuming that the "on" button 20 has not been depressed, depress one of the buttons 26, 28 or 30. Because the initiation signal was earlier produced, generating the mode selection signal under these conditions will cause the motor 32 to drive the belt 18 according to the selected speed. If the second user was not expecting the belt 18 to accelerate suddenly, the user may fall down or be thrown from the belt 18 off of the treadmill 10. The shut-off means 38 prevents such an undesirable event by disconnecting all power from the motor 32 when a mode selection signal is not produced within a preselected time period after the initiation signal is generated.

Figure 3:
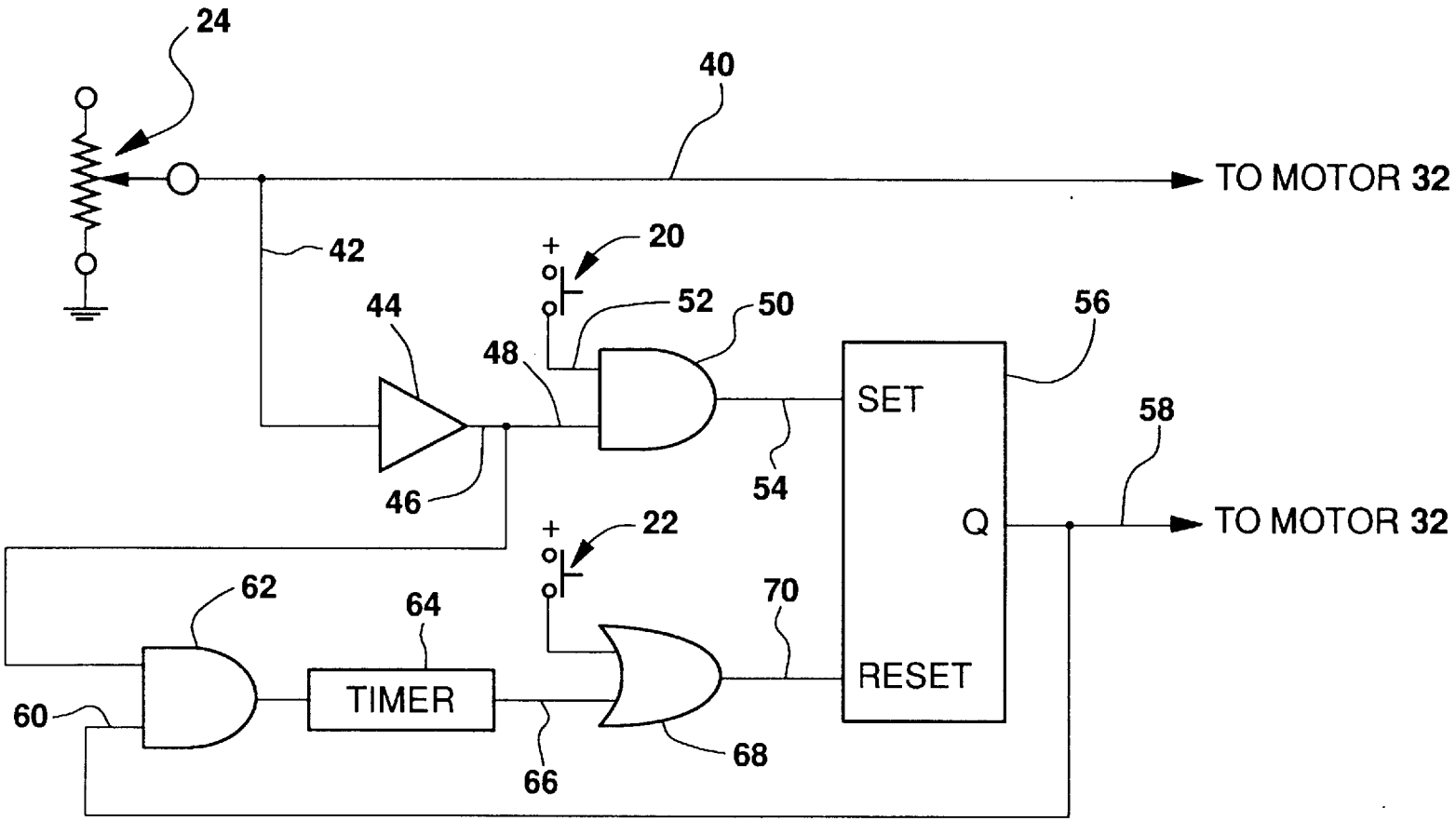
FIG. 3 is a schematic diagram of a presently preferred embodiment of a control circuit designed in accordance with this invention.

FIG. 3 is a schematic diagram illustrating circuitry useful for implementing this invention. The mode selection signal generating means 24 comprises a speed potentiometer. Adjusting the speed potentiometer 24 produces an analog mode selection signal along a signal line 40, which is supplied to the motor 32 in a conventional manner. The adjustment of potentiometer 24 can be accomplished by depressing one of the buttons 26, 28 or 30 or, alternatively by manually adjusting a rotatable knob or lever or any other conventional adjustable switching mechanism.

The mode selection signal is also conducted along a signal line 42 and input into a comparator 44. The comparator 44 compares the signal on the line 40 to a preselected nominal value, preferably ground, in order to determine whether the mode selection signal has been produced. The comparator 44 normally produces a high output signal along a line 46. (The terms "high" and "low" as used in this specification refer to logic signal values.) When the comparator 44 determines that a mode selection signal above the preselected nominal value has been produced, the output at 46 goes low. The output of the comparator 44 is propagated along a signal line 48 to an AND gate 50.

The AND gate 50 is also coupled through a signal line 52 to the "on" button 20. When the switch of the "on" button 20 is depressed and the mode selection signal is zero, the output of the AND gate 50 goes high. The output of the AND gate 50 is conducted along a signal line 54 to the set input of a flip-flop 56. When the flip-flop 56 is set its output is an initiation signal that is transmitted to the motor 32 along a signal line 58 in a conventional manner. The production of the initiation signal effectively couples the motor 32 to a conventional power supply.

The output of the flip-flop 56 is also coupled to an input 60 of an AND gate 62. The other input of the AND gate 62 is coupled to the output of the comparator 44. Therefore, when an initiation signal is produced and the mode selection signal is not produced, both inputs to the AND gate 62 are high. Accordingly, the output of the AND gate 62 goes high, thereby initiating a timer 64.

The timer 64 can be any conventional counter or other timing device that can be set to run for a preselected time period. The output of the timer 64 is low while the timer is running. After expiration of the preselected maximum time period, the output of the timer 64 goes high. This high signal is conducted along a signal line 66 to an OR gate 68. The OR gate 68, in turn, produces a high output along a signal line 70. The signal line 70 is coupled to the reset input of flip-flop 56 and the initiation signal along the line 58 is, therefore, terminated.

The timer 64 preferably is set to run only when the output of the AND gate 62 is high. Accordingly, when a mode selection signal is produced (i.e., the signal from the speed potentiometer 24 exceeds the preselected nominal value) the output of the comparator 44 goes low, in turn causing the output of the AND gate 62 to go low. Therefore, the timer 64 will be interrupted. Once the timer 64 is interrupted it stops counting, for example, and does not produce a high output at 66. Accordingly, if the mode selection signal is generated prior to expiration of the preselected maximum time, the flip-flop 56 is not reset, the motor 32 stays coupled to the power supply 34 and the motor operation proceeds according to the mode selection signal produced.

The above-described circuit operates assuming that the motor control logic requires a positive or high signal along the lines 58 and 42.

A user can manually terminate the operation of the motor 32 by depressing the "off" button 22, which causes the flip-flop 56 to be reset, thereby shutting off the signal along the line 58.

As can be appreciated, the method associated with this invention of controlling a treadmill includes four basic steps. First, a plurality of signals to cause the motor to drive the belt are produced. The plurality of signals includes an initiation signal and a mode selection signal. The time when each of the plurality of signals is produced is determined. The time period between the production of the initiation signal and the mode selection signal is monitored and all power to the motor is shut off when the time period between production of the initiation and mode selection signals exceeds a preselected maximum.

Figure 4:
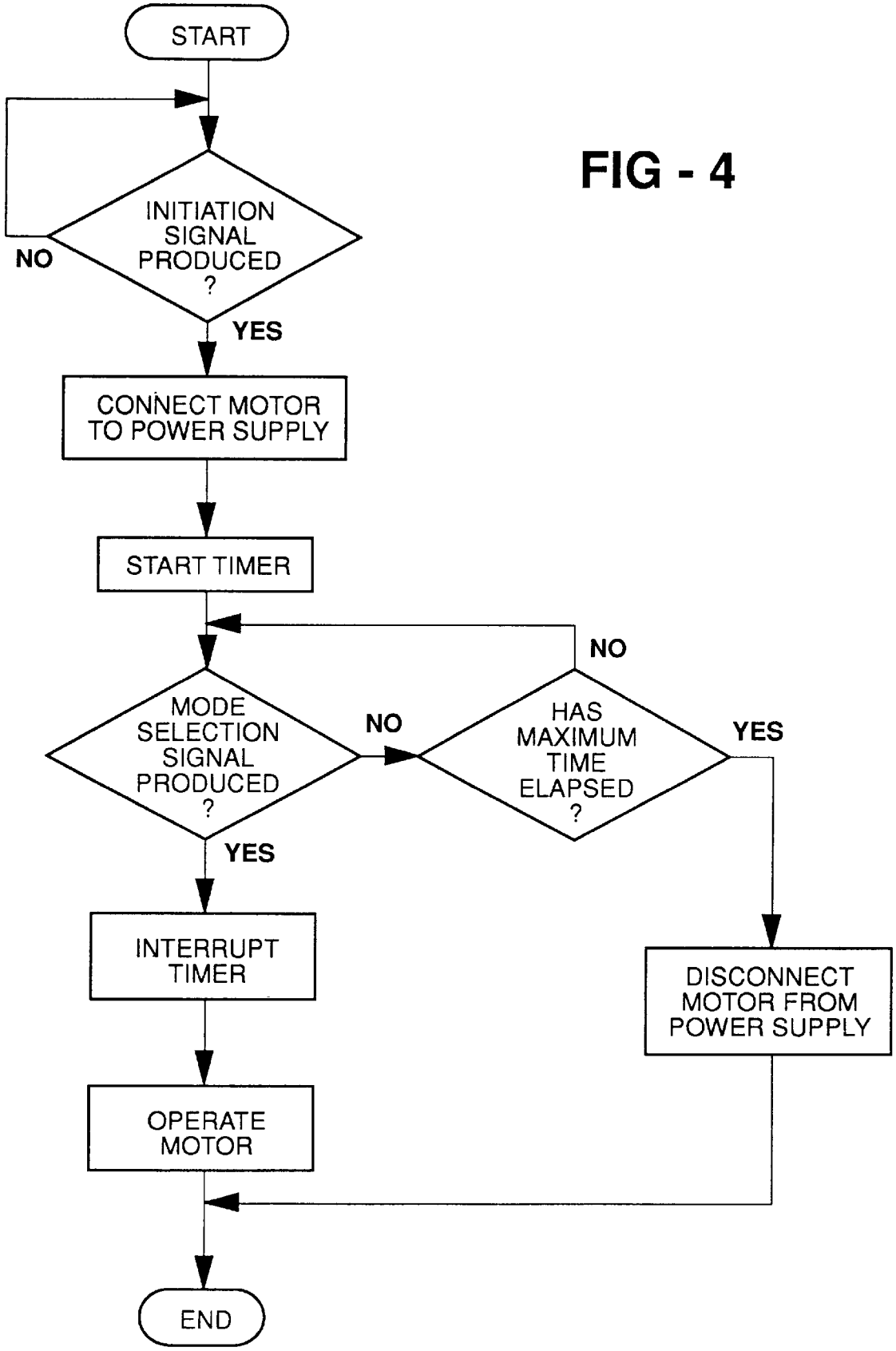
FIG. 4 is a flow chart illustrating the methodology associated with this invention.

FIG. 4 is a flow chart diagram illustrating the methodology associated with this invention. The determination of whether the initiation signal has been produced is made in order to determine whether the motor 32 should be connected to the power supply 34 and whether the timer 64 should be initiated. An initiation condition exists once the initiation signal has been produced. Once the timer is initiated, the signal detector 36 determines whether a mode selection signal has been produced. An operation condition exists once the mode selection signal has been produced during the initiation condition. If the mode selection signal is not produced within the preselected maximum time period then the motor 32 is disconnected from the power supply 34. If the mode selection signal is produced within the preselected maximum time then the timer is interrupted and the motor is operated in accordance with the mode selection signal.

The timer 64 can be set to run for any reasonable amount of time. In one embodiment, the timer 64 is set to run for fifteen seconds. A time period of fifteen seconds allows a user to press the "on" button 20 and make a decision about the desired speed of the treadmill belt 18. A fifteen second interval also substantially decreases the likelihood that a second user will step onto the belt 18 and cause a mode selection signal to be generated while the motor 32 is coupled to the power supply 34, which would cause an unexpected acceleration of the belt 18. Shorter or longer time periods are possible provided that a user has a reasonable amount of time to make a mode or speed selection after causing an initiation signal to be generated.

Reffering back to FIG. 1, another feature of this invention is illustrated. An overtravel pedal 80 is provided at the rear of the belt 18. The pedal 80, which preferably is a plate, is located below the plane of the belt 18 to avoid inadvertent contact with the pedal 80. The pedal 80 is connected to a mechanical safety switch that is actuated by a person that is propelled off the rear of the treadmill when that person contacts the pedal 80. When the mechanical safety switch is thrown, all power is cut off from the motor 32. Accordingly, the belt 18 stops rotating immediately in the event that a user accidentally is propelled off the rear of the belt 18. This feature provides significant advantages in preventing further injury to a user that accidentally falls while using the treadmill 10. It is also within the scope of this invention to provide a conventional dynamic braking arrangement to facilitate stopping the belt 18 when the mechanical safety switch is thrown.

Figure 6:
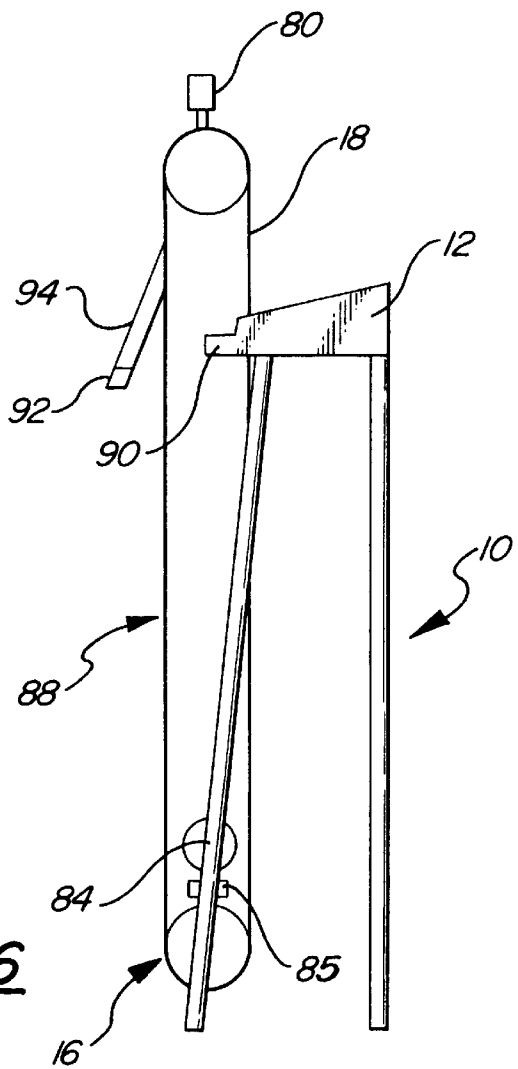
FIG. 6 illustrates the embodiment of FIG. 5 in a non-use position.
Figure 5:
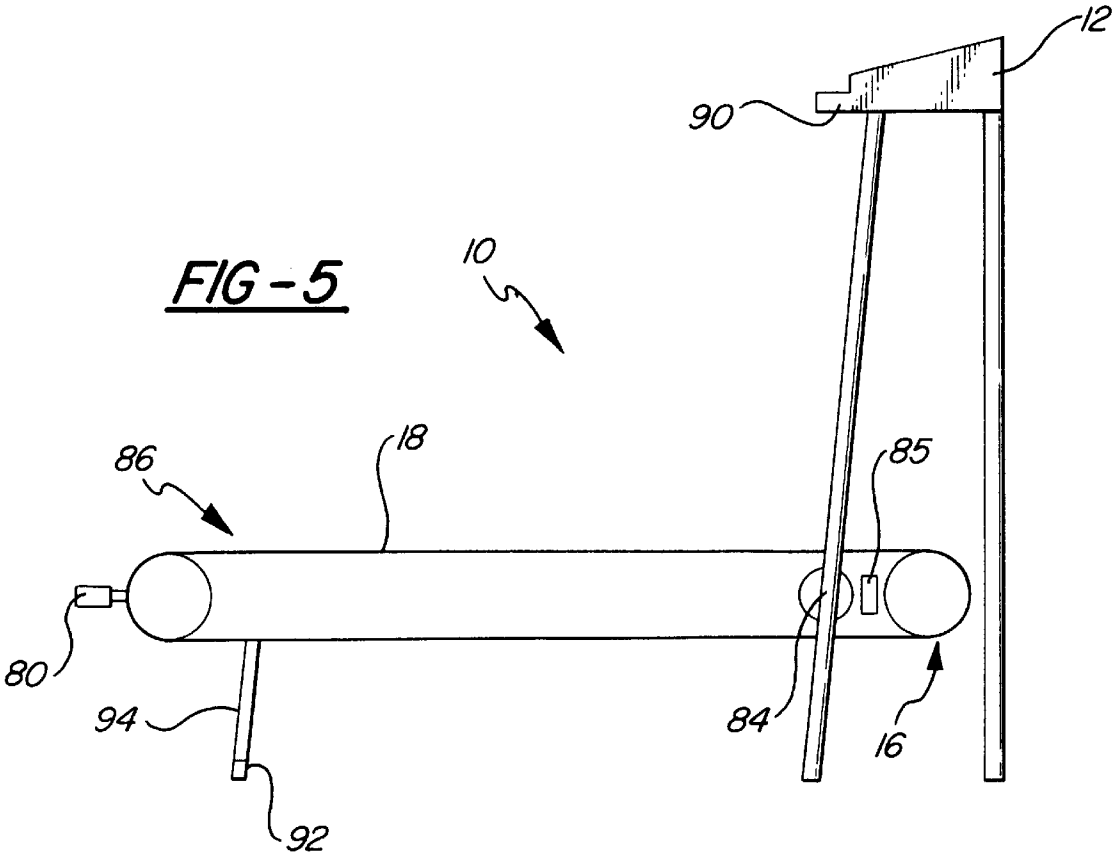
FIG. 5 is a schematic illustration of another embodiment of this invention in a use position.

FIGS. 5 and 6 illustrate another embodiment of a treadmill incorporating further safety features provided by this invention. The treadmill 10 of FIGS. 5 and 6 has the ability for moving the belt 18 about a pivot point 84 from a use position 86 (illustrated in FIG. 5) to a non-use or storage position 88 (illustrated in FIG. 6). It is important that the treadmill 10 not be operable when the belt 18 is in the storage position 88. Accordingly, this invention provides a sensor, which is mounted to the belt housing or the motor housing 16, that produces electrical signals indicative of the position of the belt 18. Any commercially available sensor or switching assembly will be suitable. Those skilled in the art will understand what types of sensor arrangements would be appropriate and, therefore, they need not be described further in this specification.

An additionally safety feature provided by this invention is a mechanical locking member 90. The mechanical locking member 90 preferably includes a moveable latching member for attaching to and maintaining the belt 18 in the non-use storage position 88. As an additional feature, the locking member 90 preferably is provided with a switch assembly that generates an electrical signal indicative of whether the locking member 90 is in a locking or non-locking position. Any commercially available locking member and switching system can be utilized.

The electrical signals produced by the position determining means 85 and the switching arrangement coupled to the locking member 90 preferably are processed by a microprocessor located within the control panel 12. The signals produced to indicate that the belt 18 is in a use position can be processed by the signal detector 36. When the position detector 85 and the locking member 90 indicate that the belt 18 is in the non-use position, the signal detector 36 allows the treadmill 10 to be operated, provided that the appropriate sequence of signals within prescribed time limits are generated by a user manipulating the control panel 14 as described above. When the locking member 90 is in a locking position, however, the signal detector 36 immediately and constantly prevents power from being transmitted to the motor 32. Similarly, when the position detector 85 indicates that the belt 18 is not in the use position 86, no power is supplied to the motor 32.

The switching feature of the locking member 90 also can be used as an auxiliary shutoff switch. For example, the locking member 90 preferably is mounted on the treadmill 10 to be within the grasp or reach of a user of the treadmill 10. In the event that the user wants to immediately shutoff the power to the motor 32, to thereby stop the belt 18 from rotating, the user could reach forward and move the locking member 90 into a locking position, thereby throwing the associated switch. Accordingly, providing a locking member 90 with a switch arrangement that produces a signal indicating that the power to the motor 32 should be cutoff provides more than one advantage.

Another feature of this invention is to provide a pressure sensor 92 in a folding leg 94. When the treadmill belt 18 is in the use position 86, the leg 94 supports one end of the belt 18 against the floor (or whatever surface the treadmill 10 is standing on). In the non-use position 88, the leg 94 does not serve a weight-bearing function. Accordingly, providing a pressure sensor 92 on the leg 94 serves as an additional indicator of whether the belt 18 is properly placed in the use position 86. Whenever a signal from the pressure sensor 92 within the leg 94 does not indicate that the belt 18 is properly supported in the use position 86, no power is supplied to the motor 32. Any known pressure sensor 92 can be incorporated on the leg 94.

The overtravel pedal 80 most preferably is incorporated into the embodiment of FIGS. 5 and 6, and operates in the same manner as described above.

The preceding description is exemplary rather than limiting in nature. Variations and modifications will become apparent to those skilled in the art that do not depart from the purview and spirit of this invention. The scope of this invention is to be limited only by the appended claims where reference numerals are provided for convenience only and are not to be construed to be limiting in any way.

I claim:

1. An apparatus for controlling a treadmill (10) having a motor (32) that drives a belt (18) that can be moved between a use position (86) and a storage position (88), comprising:

a control panel (14) having signal producing means (20-30) for producing a plurality of signals, said plurality of signals including an initiation signal and a mode selection signal;

signal detecting means (36) for detecting when each of said plurality of signals is produced by said producing means;

position determining means (85) for determining whether the belt is in the use position (86); and characterized by preventing means, coupled to said position determining means, for preventing the motor from being powered to drive the belt when said belt is not in the use position and shutoff means (38), coupled to said signal detecting means (36), for monitoring a time period between production of said initiation signal and said mode selection signal and for shutting off all power to the motor (32) when said time period exceeds a preselected maximum.

2. The apparatus of claim 1, wherein said position determining means (85) includes a sensor that produces an electrical signal indicative of the position of the belt (18), and wherein said preventing means is responsive to said electrical signal.

3. The apparatus of claim 1, wherein said shutoff means (58) includes a timer (64) that is initiated upon production of said initiation signal and that is set to run for a timer period that equals said preselected maximum and wherein said timer includes means for producing a timeout signal at an end of said timer period.

4. The apparatus of claim 3, wherein said shutoff means (38) further comprises enabling means (56) for producing an enabling signal that enables the motor (32) to drive the belt (18) upon production of said mode selection signal.

5. The apparatus of claim 4, wherein said timer (64) is coupled to said enabling means (56), said enabling means produces said enabling signal upon production of said initiation signal and wherein said enabling means terminates said enabling signal upon production of said timeout signal.

6. The apparatus of claim 5, wherein said detecting means (36) is coupled to said timer (64), said detecting means operating to turn off said timer upon production of said mode selection signal.

7. The apparatus of claim 6, further comprising a belt (18), a motor (32) for driving said belt and a power conductor for coupling said motor (32) to a power source (34) and wherein said shutoff means (38) is coupled between said motor and said power conductor.

8. The apparatus of claim 2, wherein said position determining means (85) further includes a locking member (90) for locking said belt (18) in the storage position (88) and a locking switch for producing an electrical signal indicative of whether said locking member is in a locking position.

9. The apparatus of claim 8, wherein said preventing means prevents said motor from being powered when said indicator signal indicates that said belt is not in the use position (86) or when said locking switch indicates that said locking member (90) is in a locking position.

10. The apparatus of claim 1, further comprising an overtravel pedal (80) located adjacent said belt (18) and having a switch operative to disconnect said motor (32) from a power source (34) when a user contacts said overtravel pedal (80).

11. A method of controlling a treadmill (10) that has a motor (32) that drives a belt (18), comprising the steps of:

(A) producing a plurality of signals to cause the motor (32) to drive the belt (18), the plurality of signals including an initiation signal that is required for the motor to be coupled to a power source and a mode selection signal, wherein the motor drives the belt responsive to the mode selection signal only when the motor is coupled to the power source;

(B) determining when each of the plurality of signals is produced;

(C) monitoring a time period between production of the initiation signal and subsequent production of the mode selection signal; and (D) uncoupling the motor (32) from the power source when the time period from step (C) exceeds a preselected maximum.

12. The method of claim 11, wherein step (C) is performed by the substeps of defining an initiation condition when the initiation signal has been produced and defining an operation condition when the mode selection signal has been produced during the initiation condition.

13. The method of claim 11, wherein step (C) is performed by the substeps of initiating a timer upon determining that the initiation signal has been produced and setting the timer to run for the preselected maximum time period of step (D), the timer being operative to initiate step (D) upon expiration of the preselected maximum time period.

14. The method of claim 13, further comprising the step of disabling the timer upon determining that the mode selection signal has been produced before expiration of the preselected maximum time period.

15. The method of claim 11, further comprising determining whether the belt (18) is in a use position (86) and performing steps (A) through (D) only when the belt (18) is in the use position (86).

16. A treadmill assembly, comprising:

a motor (32);

an exercise surface (18) that is driven by said motor;

position determining means (85) for determining whether the exercise surface (18) is in a use position (86); and characterized by preventing means, coupled to said position determining means, for preventing said motor (32) from being powered to drive said exercise surface when said exercise surface is not in the use position.

17. The assembly of claim 16, wherein said position determining means (85) includes a position indicator sensor that produces an electrical indicator signal indicative of the position of the exercise surface.

18. The assembly of claim 17, wherein said position determining means further includes a locking member (90) for locking said exercise surface in a non-use position (88) and a locking switch for producing an electrical signal indicative of whether said locking member is in a locking position, and wherein said preventing means prevents said motor from being powered when said indicator signal indicates that said exercise surface is not in the use position or when said locking switch indicates that said locking member is in the locking position.

19. The assembly of claim 18, further comprising a support member (94) for supporting the exercise surface (18) in the use position (86) and wherein said position determining means further includes a pressure sensor (92), mounted on said support member, for producing an electrical signal indicative of when the exercise surface is supported by said support member in the use position.

20. The assembly of claim 19, further comprising an overtravel pedal (80) supported adjacent one end of the exercise surface (18) and being coupled with a switch that is operative to disconnect said motor from a power source when a user contacts said pedal.

* * * * *